United States Patent [19]

Brosius et al.

[11] Patent Number: 4,687,126

[45] Date of Patent: Aug. 18, 1987

[54] POWER ACTUATED TOOL FOR DRIVING FASTENER

[75] Inventors: James R. Brosius; Ralph C. Brosius, both of St. Louis, Mo.

[73] Assignee: Research Plus, Inc., St. Louis, Mo.

[21] Appl. No.: 800,610

[22] Filed: Nov. 21, 1985

[51] Int. Cl.[4] ..... B25C 1/12

[52] U.S. Cl. ..... 227/10; 173/134

[58] Field of Search ..... 173/134; 227/10, 8, 227/9, 11

[56] References Cited

U.S. PATENT DOCUMENTS

| | | | |
|---|---|---|---|
| 3,494,532 | 2/1970 | Bayer et al. . | |
| 3,499,590 | 3/1970 | Bayer et al. . | |
| 3,552,625 | 1/1971 | Udert . | |
| 3,554,425 | 1/1971 | Oesterle . | |
| 3,688,964 | 9/1972 | DeCaro . | |
| 3,708,238 | 1/1973 | Kissane . | |
| 4,068,790 | 1/1978 | Osterle et al. . | |
| 4,252,259 | 2/1981 | Brosius . | |
| 4,406,079 | 9/1983 | Buechel et al. | 227/10 X |

*Primary Examiner*—E. R. Kazenske
*Assistant Examiner*—Willman Fridie, Jr.
*Attorney, Agent, or Firm*—Paul M. Denk

[57] ABSTRACT

A fastener driving tool for use for driving a nail or other anchor into a hardened surface, such as concrete, the tool applicable for feeding a cartridge strip of magazined explosive cartridges through the tool for repeated subsequent driving of a plurality of fasteners into such a surface, the tool incorporating a handle, a tubular housing provided extending forwardly from the handle, a barrel cylinder provided for limited reciprocal movement within the tubular housing, a cartridge chamber provided at the rear of said barrel cylinder for contiguous reception of a cartridge therein in preparation for firing, a piston provided within the barrel cylinder and provided for reciprocal movement therein between a set position arranged approximate the back segment of the barrel cylinder and at its front segment as after a firing and driving of a fastener in place, the barrel cylinder and piston capable of being reset in preparation for refiring, a feed housing mounted upon the barrel cylinder, providing for an indexing of the cartridge strip through the feed housing upon the handle means for selective positioning of a next cartridge aligned with the cartridge chamber in preparation for a next firing, the indexing provided through a circular indexing wheel that is shifted by a carriage device operatively associated within the feed housing.

26 Claims, 43 Drawing Figures

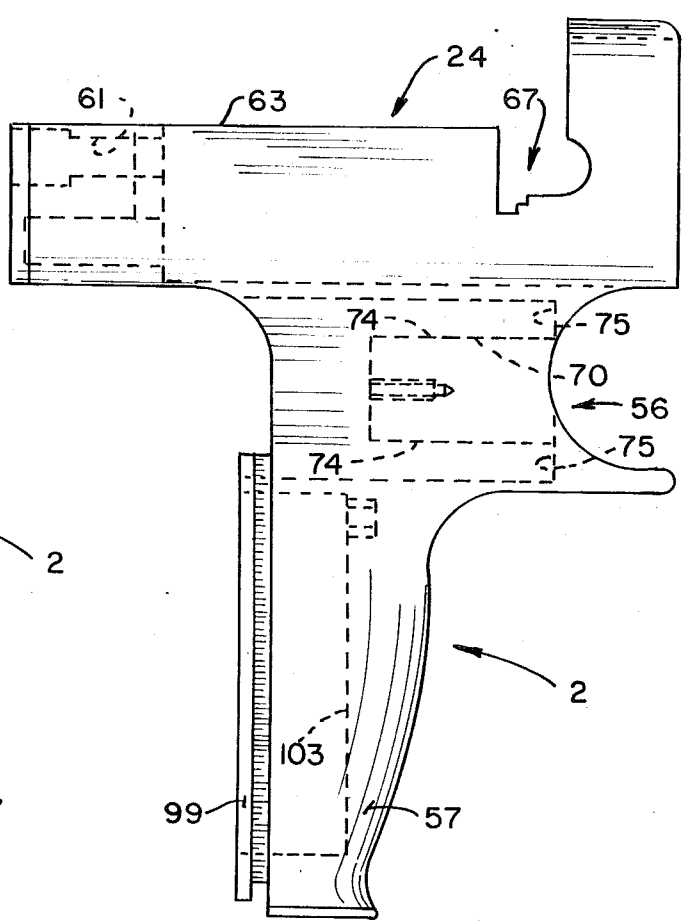
FIG. 10.
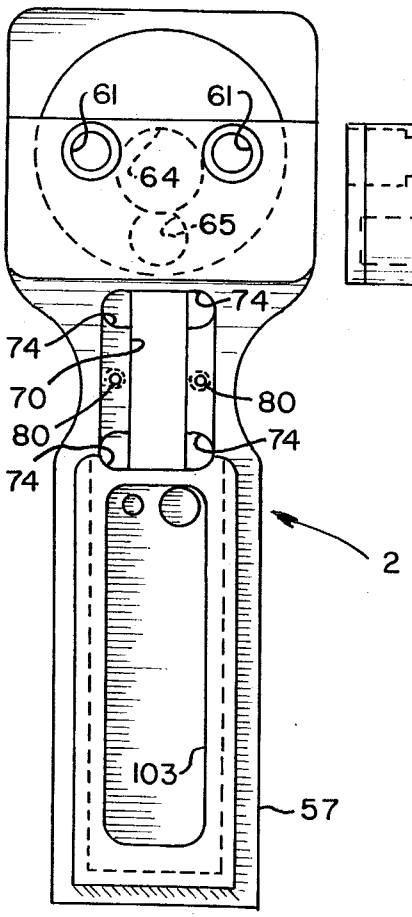
FIG. 9.
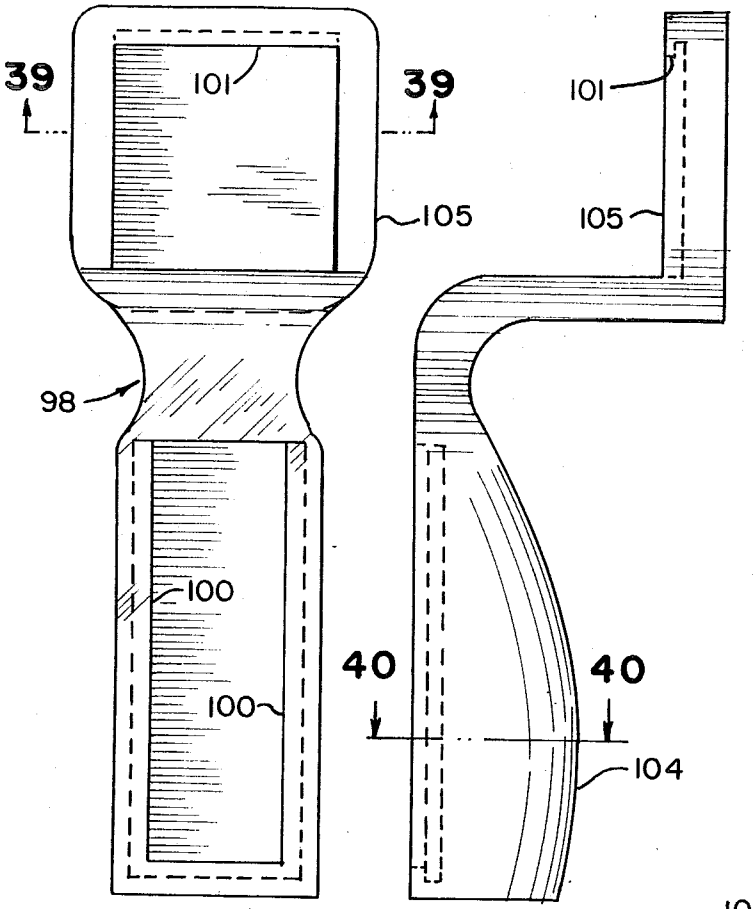
FIG. 37.
FIG. 38
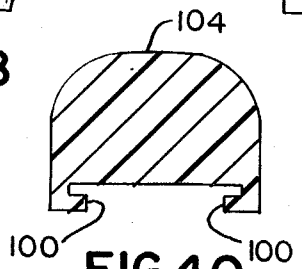
FIG. 40.
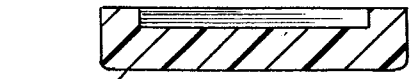
FIG. 39.

POWER ACTUATED TOOL FOR DRIVING FASTENER

BACKGROUND OF THE INVENTION

This invention relates generally to a fastener driving tool, and more specifically pertains to a fully indexable tool for use for driving fasteners or anchors into a hard and supporting surface, through the application of the explosive force generated from fully indexable strip of cartridges.

A significant number of a variety of apparatus for driving anchoring means are readily available and known in the art. In addition, such apparatuses are generally employed in the construction industry, and principally having application for driving of fasteners into those types of rigid surfaces which, under ordinary conditions, cannot otherwise have a nail or other anchoring means driven into them due to the heavy density of such surfaces. Examples of such surfaces as a concrete wall or floor, or various steel beams, studs, or the like, are of the type of surfaces into which the standard fastener cannot be applied, as through manual or other power tools, and therefore, require the usage and application of explosive force for driving the fastener instantaneously under significant pressures into these type of hardened structural components.

Examples of the type of prior art anchor inserting devices may be seen in the U.S. Pat. No. 3,494,532, to Bayer, et al, upon a piston return apparatus for an anchor means inserting device. As can be seen, a series of cartridges are longitudinally fed just beneath its barrel structure, through its parallel arranged port arm, for vertical shifting of each cartridge consecutively into a cartridge chamber in preparation for its firing. As can also be noted, there is the piston means arranged within its cylinder bore and which when subjected to the force of the fired cartridge is propelled forwardly for driving of an anchor into hard material. Another patent to Bayer, et al, U.S. Pat. No. 3,499,590, shows a related type of explosive actuated fastener setting tool.

The patent to Udert, U.S. Pat. No. 3,552,625, discloses another type of related explosive charge operated setting tool. As can be seen, in this particular instance, a series of cartridges held in a magazine are fed vertically into the direction of its barrel, for locating of its uppermost cartridge into its identified chamber, but as can be seen, it is the magazine part itself, as at its exteriorly tapered cylindrical projection 54 that is compressed within the cartridge chamber during firing. The magazine, with its plurality of cartridges, although, are automatically fed through the tool, during its usage, through the agency of its two-armed indexing lever, or feed lever, as identified.

A related type of magazine feeding mechanism for an explosive charge operated setting tool is shown in the U.S. Pat. No. 3,554,425, to Oesterle. In this particular instance, the tool is very similar to that which is shown in the prior Udert patent, affording an upward indexing vertically through the handle of the tool, throught the use of its indexing lever arms, as can be noted.

Another fastener drive tool for caseless loads is explained in the United States patent to DeCaro, U.S. Pat. No. 3,688,964. In this particular embodiment, the apparatus is not structured as a pistol grip or gun style of fastener driving tool, but to the contrary, is more in the nature of a linear structured form of apparatus incorporating a ram for driving a fastener through the agency of an explosive load. It does not appear upon reviewing this document, though, that it incorporates any form of cartridge strip or magazine load for providing automatic resetting of the drive tool for subsequent reusage.

A further patent to Oesterli, U.S. Pat. No. 4,068,790, discloses another form of power control arrangement for an explosive power-driven setting gun. As can be noted, the function of this patented device apparently is to provide a means for setting and varying the volume of the combustion gases generated within the piston during the ignition of a cartridge while effecting an explosive power-driving of a fastener into a hardened surface, as can be seen pictorialy within the drawings for this particular patent.

Finally, another form of hammer drive tool is shown in the U.S. Pat. No. 4,252,259, to one of the inventors of this current application, and which utilizes a single load power charge for driving of a fastener through the agency of a cylindrical ram or piston rod arranged for sliding movement through its barrel arranged bore, as noted. Indexing of subsequent charges through the hammer drive tool disclosed therein was not of consideration.

It is therefore, the principal object of this invention to provide a novel method for indexing of a cartridge strip through a tool or apparatus for repeat driving of fasteners into hardened surfaces.

Another object of this invention is to provide a fastener driving tool incorporating, in combination, a barrel cylinder means for locating within a tubular housing for the apparatus and which cooperate to provide for ease of resetting and application of the device for subsequent firings.

Another object of this invention is to provide a guard means proximate the forward end of the device and which functions to prevent an air firing, or misfiring, of the apparatus during usage.

Still another object of this invention is to provide a lateral feed under indexing arrangement for advancing a cartridge strip laterally through a fastener driving tool.

Still another object of this invention is to provide various carriage means operating in conjunction with an indexing wheel for providing the automatic resetting of a cartridge strip within a fastener driving tool in preparation for immediate subsequent applications.

Yet another object of this invention is to provide for the incorporation of a particle attractor within the structure of a fastener driving tool and which functions to attract debris and exhaust exiting from the apparatus during a firing, accumulates the debris therein, dampens the sound of the firing, and provides a convenient hand gripping means for facilitating the stable hold of the apparatus during its usage.

Still another object of this invention is to provide a fastener driving tool and which provides a cushioned back surface that not only functions to dampen the impact from recoil of the apparatus during its usage, but likewise forms a convenient cover for the various operating components, and the servicing tool storage compartment, operatively associated with an integrally formed within the handle for the apparatus.

Another object of this invention is to provide a cartridge feeding indexing mechanism that aligns each cartridge in contiguity within the firing chamber in preparation for the explosive driving of a fastener, while preventing the rearward or lateral discharge of any forces of combustion generated during a firing procedure.

Still another object of this invention is to provide a fastener driving tool that is fabricated from approximately four major and integrated components, which can be easily disassembled, with just a single or two tools, to facilitate the servicing of the device during and subsequent to its application.

These and other objects will become more apparent to those skilled in the art upon reviewing the summary of this invention, and upon undertaking a study of the description of its preferred embodiment, in view of the drawings.

SUMMARY OF THE INVENTION

This invention contemplates the formation of a power actuated tool for driving fasteners, in the category of nails, anchors, or other instruments that need to be driven into generally excessively hardened surfaces, such as a concrete wall, or floor, a metal structure, or the like. Generally, the tool is fabricated from a complex of components, which are conveniently assembled into approximately four basic structured components, and which are easily assembled, or disassembled, the latter occurring when servicing is required. More specifically, the device is designed, when assembled, for providing a totally automated unit, that can readily provide for repeat performance during its application, with the only manual participation really being required is the reloading of the fastener at the muzzle end of the apparatus just prior to its ignition. More specifically, these basic components include a tubular member incorporating the various barrel cylinder means, with the reciprocating piston therein, and which is generally designed for being set up for propulsion at a rearward segment of the cylinder means, but, during a firing, is thrusted forwardly under excessive forces generated from an igniting cartridge for driving of the fastener sufficiently and stabily into the structured supporting surface, of the type as just previously explained. The tubular housing means is designed for snug mounting upon the handle means for the invention, and which handle means is conveniently shaped for grasping by the operator, during its usage, to add to the facility of the device during application. In addition, the handle means is of utilitarian shape having a cavity therein, and which is closed by means of a cover, and more specifically one constructed of a cushioning material, which when applied to the stock or rear end of the tool not only provides a means for retention of any servicing tool within the handle cavity, but likewise, provides a cushioning for the operator against any impact or recoil experienced by the instrument during a firing. In addition to the foregoing, the handle means incorporates a rather conveniently designed trigger mechanism that can be easily squeezed by the operator during an application of the device.

A fourth segment of the apparatus includes a feed housing mechanism, that conveniently and uniformly is rigidly applied onto the handle means, and just rearwardly integrated into the structure of the tubular housing, and which is designed to provide for the enhanced attributes of this invention in furnishing an indexing means useful for providing for the horizontal or lateral shifting tranversely of a cartridge strip, in the nature of a magazined series of cartridges, through the apparatus for repeat firings, during constant usage of the tool. The indexing means includes an indexing wheel, generally of circular design, having a series of toothed segments and surface gears which cooperate with other mechanism for assuring the precision indexing of the cartridge strip, one step at a time, during repeated usage of the apparatus. The indexing wheel cooperates with a carriage, which is responsive to the operating components within the tubular housing, namely, the barrel cylinder means, so that as the tool is pressured against the structural surface in which the just loaded fastener is to be driven, the cartridge strip is automatically indexed, one cartridge, so as to move the spent cartridge to the side, for eventual disposition, while relocating in precision alignment of the next cartridge for loading into proximity within the piston cylinder combustion chamber, for ready firing upon the squeeze of the trigger means of the handle.

Preparation of the fastener driving tool of this invention for subsequent and repeat firings can easily be performed, by simply urging the operating components of the tubular housing, and more specifically its barrel cylinder means and piston arranged therein, through a forwardly directed force, which causes these various cylinder means to move to their forwardmost extent within the tubular housing, while at the same time, a tang means mounted upon the tubular housing and which is operatively associated with the barrel cylinder, and the piston, causes the piston to shift and remain in its rearwardmost position within the barrel structure, in preparation for another firing. As the entire barrel cylinder means is forced rearwardly, against that surface into which the next fastener is to be driven, and the barrel cylinder means and its rearwardly directed combustion chamber press conveniently against the next cartridge, which will have just previously come into alignment with its combustion chamber, all the operator need to do at that time is to squeeze the trigger, and a firing of the apparatus will occur, thrusting its internally arranged piston forwardly, for driving the fastener deeply into the type of structured surface as previously explained with which the instrument of this invention is employed.

BRIEF DESCRIPTION OF THE DRAWINGS

In referring to the drawings,

FIG. 9 is a back view of the handle means segment of the invention, a shown in FIG. 3;

FIG. 10 is a right side view thereof;

FIG. 37 is a back view of the cushioning means of this invention, as also shown in FIG. 3;

FIG. 38 is a left side view thereof;

FIG. 39 is a sectional view of the cushioning means, taken along the line 39—39 of FIG. 37;

FIG. 40 is a sectional view of the cushioning means taken along the line 40—40 of FIG. 38;

DESCRIPTION OF THE PREFERRED EMBODIMENT

Figure 1:
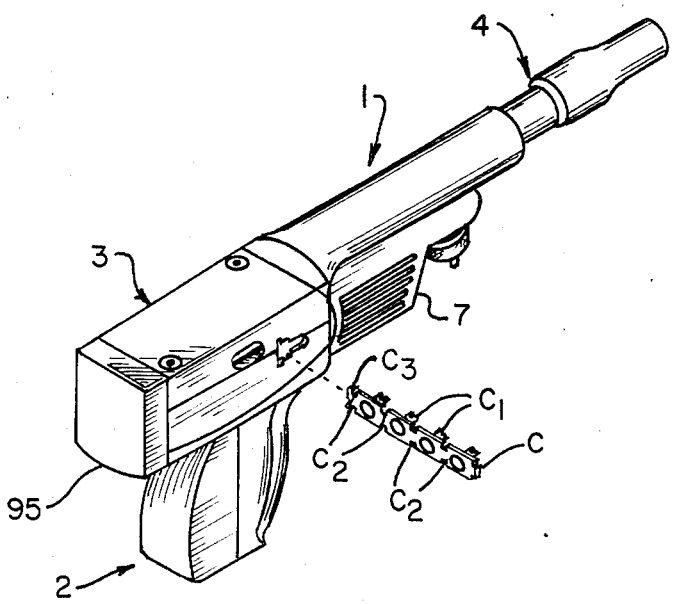
FIG. 1 provides an isometric view of the fastener driving tool of this invention.
Figure 11:
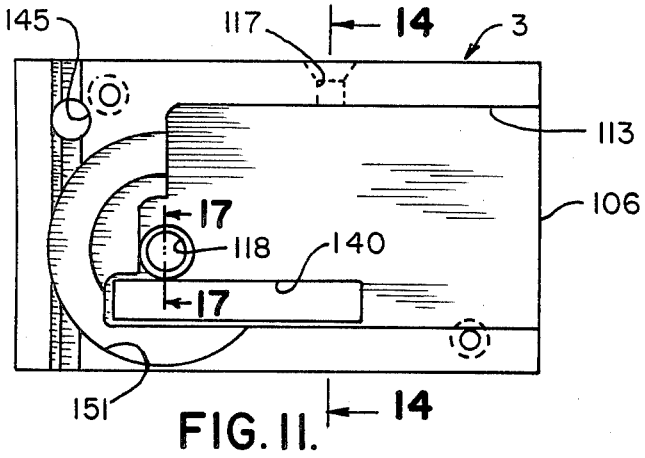
FIG. 11 is an underside view of the upper feed housing of the invention.
Figure 14:
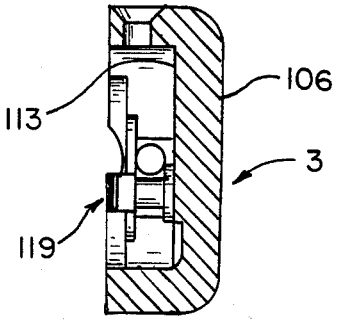
FIG. 14 is a sectional view of the upper feed housing taken along the line 14—14 of FIG. 11.
Figure 12:
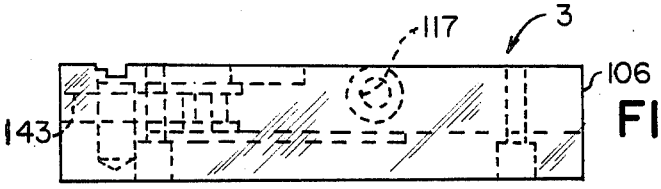
FIG. 12 is an inverted left side view thereof.
Figure 17:
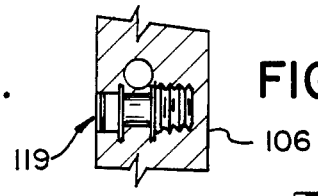
FIG. 17 is a sectional view of the upper feed housing, and more specifically showing the indexing wheel shaft, taken along the line 17—17 of FIG. 11.
Figure 13:
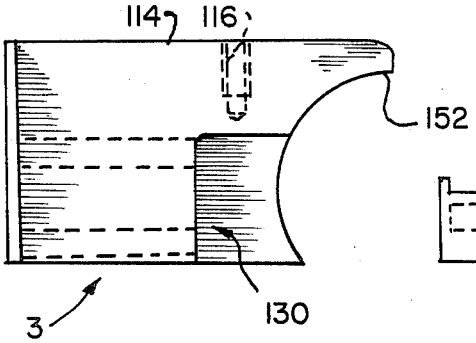
FIG. 13 is a bottom view of the lower feed housing of the invention.
Figure 15:
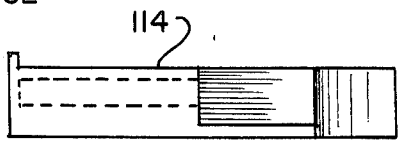
FIG. 15 is a left side view of the lower feed housing shown in FIG. 13.
Figure 16:
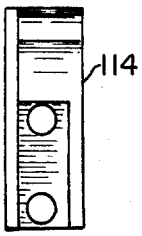
FIG. 16. is a front view of the lower feed housing shown in FIG. 13.
Figure 8:
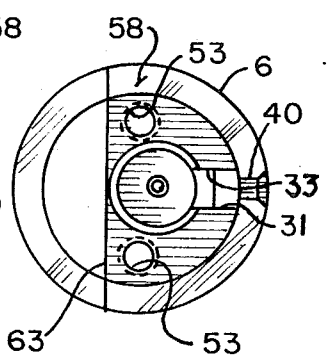
FIG. 8 is a back end view thereof.

In referring to the drawings, and in particular FIG. 1, the powder actuated tool of this invention is shown in an isometric view. The apparatus, as disclosed, includes a series of interengaging components, which when assembled into the final form, perform the function of driving a fastener into a supporting material or surface, such as those previously identified, through the usage of powder loads that are laterally fed into the apparatus during its loading. As can be seen, the apparatus includes a housing assembly 1, which may be more aptly described as a barrel or tubular housing component for the overall apparatus. See also FIGS. 6 through 8. This particular tubular housing assembly 1 mounts upon the handle component 2, and is rigidly fastened thereto, in the final assembly. This handle means, as can be obviously seen, provides a convenient gripping area for holding of the tool during its loading and application for driving a fastener into a supporting or base material, as previously explained. See also FIGS. 9 and 10. Mounted onto the upper edge of the handle means portion is the feed housing segment 3, and which particular component is more aptly shown in an exploded view in FIG. 4, and which comprises the mechanism in which the strip of cartridges is laterally fed into the apparatus in prepartion for its usage. See also FIGS. 11 through 17. In addition to the foregoing, there is a barrel cylinder assembly 4, as also disclosed in an exploded view in FIG. 5, and it is within this particular assembly that the fastener, in preparation for its application, is originally inserted and this barrel cylinder means is then cocked in preparation for an application of the apparatus. See also FIGS. 18 through 27.

Figure 2:
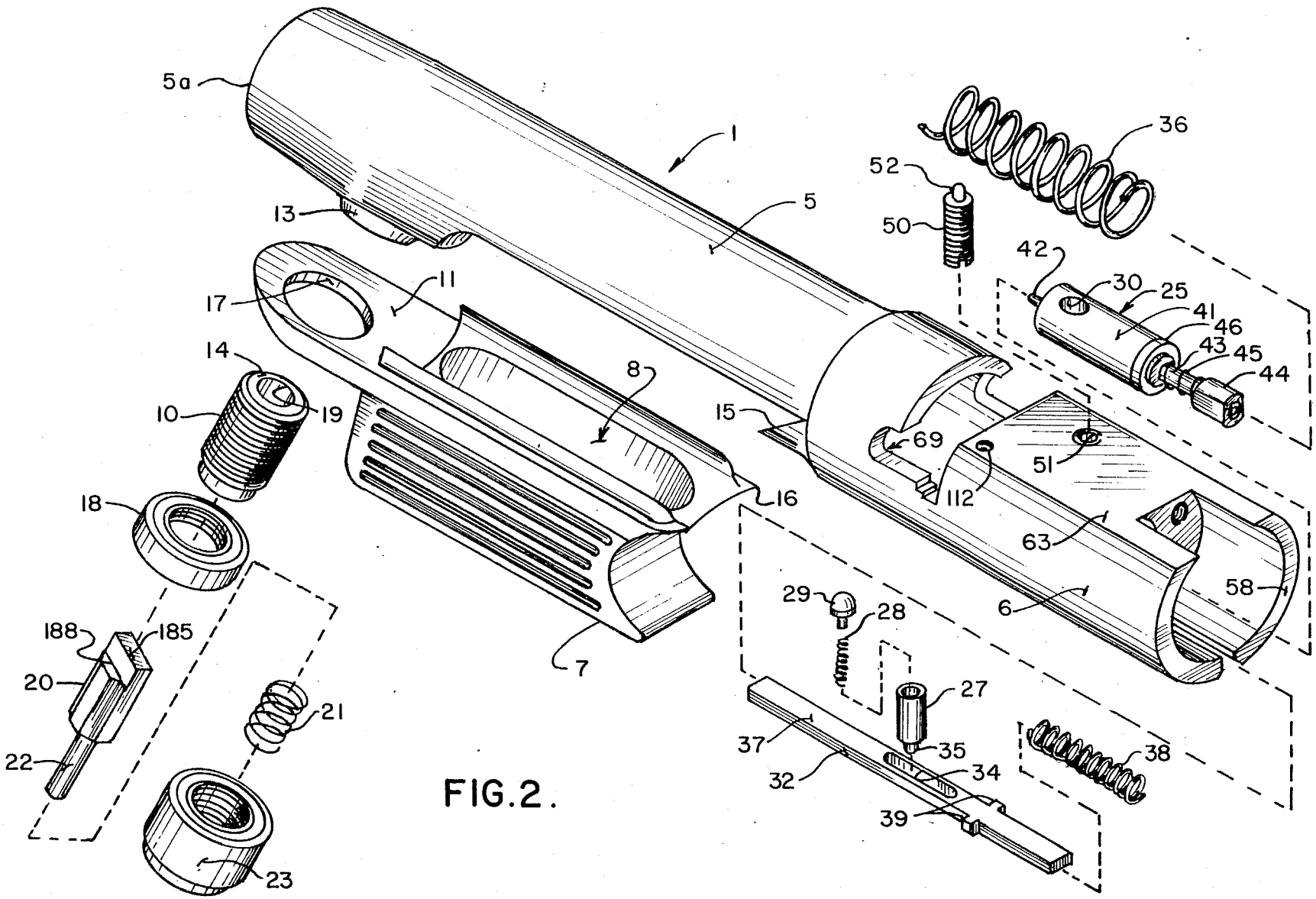
FIG. 2 is an exploded view of the tubular housing segment of the invention.

In referring particularly to FIG. 2, the tubular housing assembly or means is thoroughly disclosed in an exploded view, showing all of its component parts as integrated into the assembly before it is mounted within the structure of the overall tool or apparatus. See also FIGS. 6 through 8. As can be seen, the tubular housing assembly 1 includes the housing 5, which includes a tubular shaped housing component at its front end, as noted, and which has integrally formed at its rearward end, as at 6, the support for the feed housing means 3, and which latter means functions as the transfer means that receives and shifts the cartridges, as previously explained, and provides for an automatic lateral feeding of the cartridge strip through the apparatus, during its application and usage.

Mounting onto the underside of the tubular housing portion 5 is a particle attractor and receptor 7. See also FIGS. 2 and 28 through 30. This attractor has an internal cavity of substantial size, as at 8, formed therein, and which is provided for accumulation of the spent powder, derived from the fired cartridges, during repeated usage of this apparatus. The cavity 8 of the means 7 is in open communication with the interior, as at 9, of the tubular shaped section 5 of the housing, and as the cartridges are ignited, and exploded for driving of a fastener, the spent powder and exhaust enters into and is accumulated within this cavity 8 of the particle attractor 7. Also, as can be seen within this FIG. 2, there is a boss 10, threaded upon its external surface, and this boss 10 extends through at integrally forwardly extending flange 11 of the debris attractor 7, with said boss further extending into an opening, as at 12, provided through the bottom segment 13 of said barrel housing 5, and is rigidly secured in place, such as by threaded fastening or welding, to the barrel housing 5, with the upper surface, as at 14, of the boss, remaining flush with the interior surface 9 of the tubular housing 5. Then, in order to mount the debris attractor 7 onto the barrel housing 5, said barrel housing has a wedge shaped slot, as at 15, provided at the junction between the said tubular barrel housing 5, and its integral support for the feed housing 6, and wherein the attractor, and its rearwardly disposed dovetailed portion 16 inserts for retention of said rearward edge of said member thereat. In addition, the flange 11 of the debris attractant 7 then fits upon the boss 9, by extension of the boss through its aperture 17, of the said flange, and is fastened in place by means of the application of the nut 18 threadedly onto the boss 10, and which is securely fastened in place for firm retention of the said debris attractor in place.

In addition to the foregoing, with respect to the application of the boss 10 to the tubular housing 5, and the fastening of the debris attractant 7 in place, through the application of the nut 18, it can also be seen that the boss 10 has an internal chamber, as at 19, provided therethrough. It is through this chamber 19 that a tang 20 locates, and this particular tang is firmly held into position within and through the said chamber 19, and is biased by means of the spring 21 that fits onto the stem portion 22 of the said tang 20, which continuously urges the tang into a position internally of the tubular housing 5, for purposes to be subsequently described. The spring 21 is held into position upon the stem 22 of the tang, and firmly secured in place within the boss 10, by means of the threaded engagement of a tang cap 23 that threadedly engages upon the said boss 10, as can be noted and understood.

Figure 5:
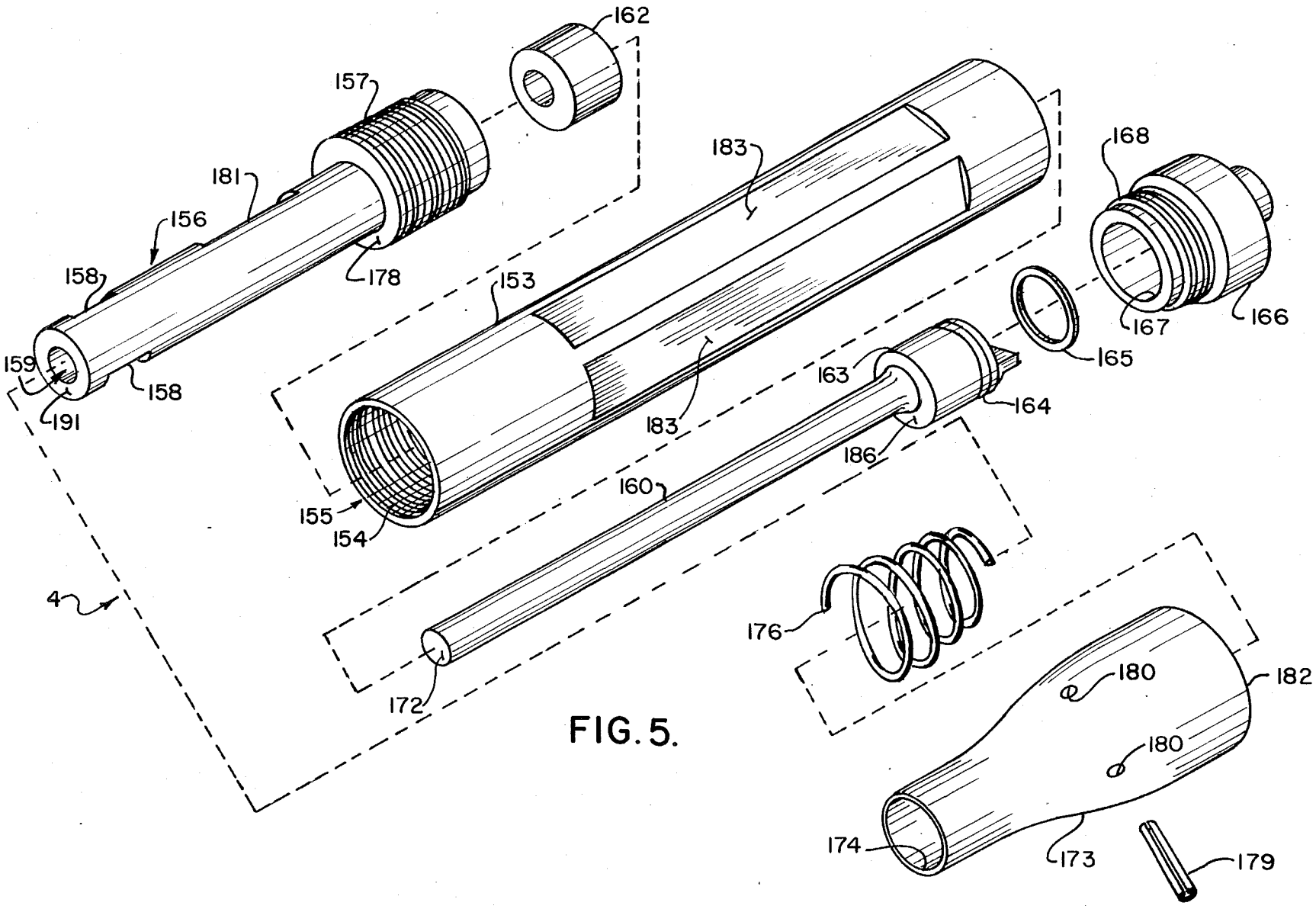
FIG. 5 is an exploded view of the barrel cylinder segment of the invention.
Figure 6:
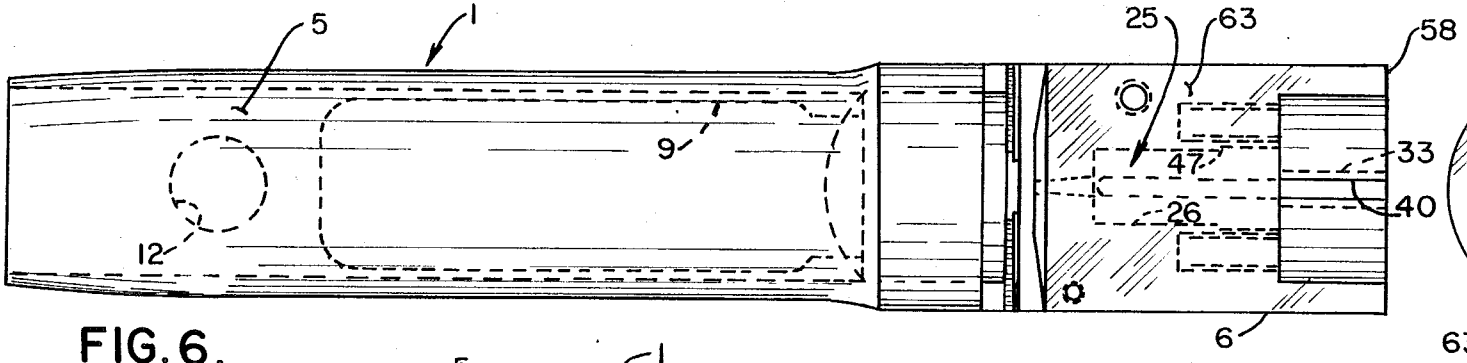
FIG. 6 is a top view of the tubular housing as shown in FIG. 2.
Figure 7:
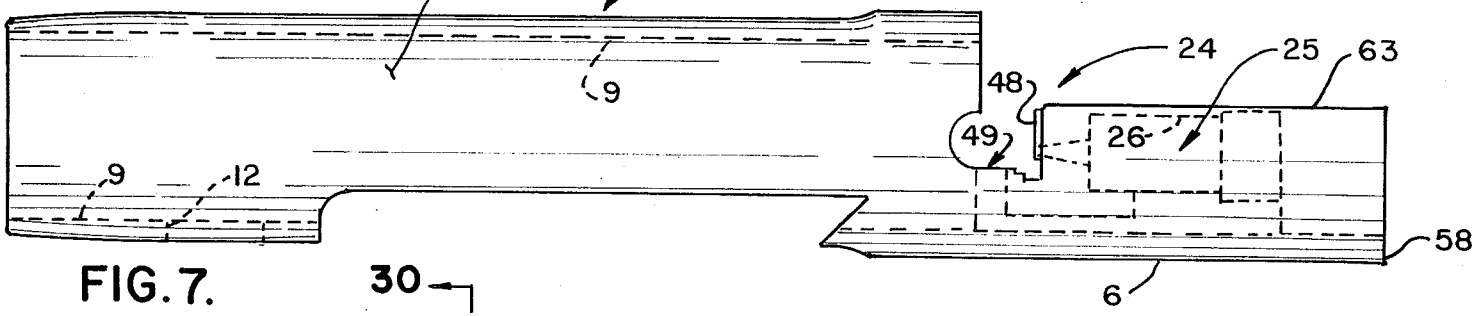
FIG. 7 is a side view thereof.
Figure 28:
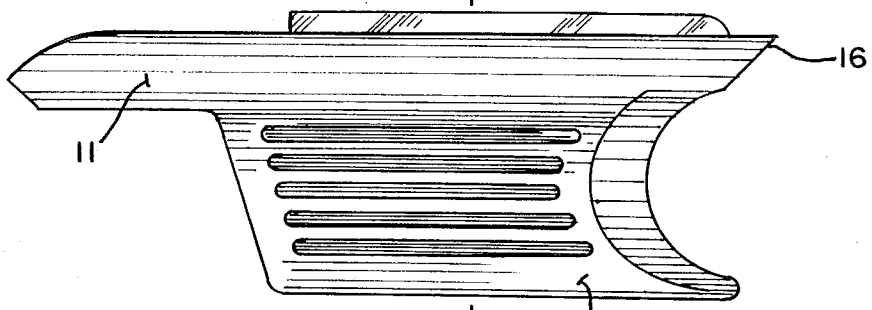
FIG. 28 is a side view of the particle attractor as also shown in FIG. 1.
Figure 29:
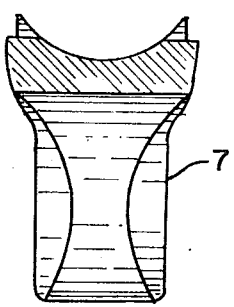
FIG. 29 is a front view thereof.
Figure 30:
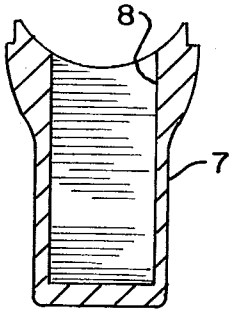
FIG. 30 is a sectional view of the particle attractor taken along the line 30—30 of FIG. 28.

The integral feed housing support 6, of the tubular housing 5, is designed for reception of the firing pin mechanism which, in application, provides for the ignition of the cartridge for driving a fastener when the apparatus is placed into usage. This particular portion of the housing is disclosed generally in exploded view, in FIG. 2, but attention is also directed to FIGS. 6, 7, and 8, of the drawings. As can be noted, this particular segment of the housing has a stepped location, shaped as shown in FIG. 7, as at 24, and it is upon this particular surface that the feed housing module of FIG. 4 mounts upon the assembly of the apparatus for usage. In any event, the housing support 6 has a series of internal chambers located therein, and into which the various firing mechanisms, such as the firing pin assembly 25 locates, as during usage. There is a cavity 26 in which the firing pin assembly 25 inserts, and is normally held into position by means of the insertion of a sear 27, and its spring means 28 biasing the sear pin 29 upwardly into the aperture 30 formed through the firing pin mechanism 25. The sear pin and its sear means 27 are normally located within the cavity 33 formed through the feed housing support 6. In addition, a push rod 32 is normally located within the rod chamber 31 provided longitudinally within the feed housing support 6, and which is in open communication with the said sear pin cavity 31. The push rod 32 has an elongated slot, as at 34, formed therein, as can be seen, and a pin means 35, integrally formed at the bottom of the sear 27, normally is located within said slot 34, as the apparatus is being recocked for further operation. But, during firing, as can be understood, a sear lever means, to be subsequently described, normally pushes upwardly upon the pin means 35, to lift the sear 27 upwardly and free from the said push rod 32, as when the apparatus is in the incipient stage of firing. As can be understood, when the sear means pin 35 is released from the push rod 32, it then in conjunction with the firing pin housing 25 is propelled rapidly forwardly, through the effort of a firing pin spring 36, and as that occurs, the sear pin 27 does slide forwardly upon the upper surface, as at 37, of the push rod 32. But, when resetting the apparatus for refiring, the barrel cylinder means, to be subseqently described, and generally as shown in FIG. 5, is urged forwardly, at which time the spring 38 of the push rod biases against the back end of said push rod 32, for urging it forwardly, until such time as the sear pin protrusion 35 re-enters the push rod slot 34, as noted. It should also be commented that the push rod 32 includes a pair of tangs 39 and these tangs are provided to function as a stop, against the sides of the channel 33, so as to prevent the push rod from entering too forwardly within the feed housing support 6.

As can also be seen in FIG. 2, in addition to FIG. 6, the bottom of the feed housing 6 incorporates a slot 40 therein, and it is through this particular slot that the sear lever, to be subsequently described, inserts during firing of the apparatus, and more specifically for lifting of the sear pin stem 35, as explained.

The firing pin mechanism 25, as previously explained in FIG. 2, includes its housing 41, having that aperture 30 provided therethrough, and into which the sear and the sear pin 27 and 29 insert, for reasons as previously explained. The front of the firing pin housing 41 has an integral protrusion 42 provided thereon, and this naturally comprises the pin that impacts the cartridge upon firing, as can be understood. The back end of the housing 41 has an integral stem 43 extending rearwardly therefrom, and incorporates a shoulder means 44, with a spring 45 located upon said stem 43, and biasing against a washer 46 that normally rests against the back edge of the firing pin housing 41, as can be seen. The spring 36, as can be noted, locates upon or over the stem 43 and the shoulder 44, and strongly biases against this washer 46, and is useful for thrusting the firing pin housing, and its firing pin 42, forwardly, upon triggering of the apparatus during a firing. As this occurs, since the washer 46 is of a slightly greater diameter than the firing pin housing 41, the firing pin housing 41, and the remaining components of its mechanism, are free for continued forward riding within the cavity 26, formed within the feed housing 6, as previously explained, but the washer 46, as stated, being of a slightly greater diameter, impacts rather abruptly against the shoulder 47 formed within the chamber 26, so as to prevent any further forward movement of the washer 46, but due to the high forward momentum provided to the firing pin mechanism 25 during a triggering, the housing 41, and its pin 42, yet continue to move slightly forwardly, during firing, so that the pin 42 can impact against the back of the cartridge, to initiate its ignition and firing of the apparatus. But, that forward momentum is immediately retracted, after firing, due to the spring 45, and the housing 41 returns back to the washer 46, so that the firing pin 42, or more specifically its forward tip, becomes flush with, or slightly withdrawn within, the surface 48 of the cartridge path, as at 49, formed integrally and laterally through the feed housing 6, where the cartridge strip passes therethrough, as can be noted, most specifically, in FIG. 7.

Also, as can be seen in FIG. 2, there is an indexing feed stop 50, that threadily engages within the aperture 51 provided through the feed housing 6, and this particular stop incorporates a spring mounted plunger, a portion of it extending upwardly as shown at 52, and which is useful for limiting the operations of the indexing means which provides for automatic setting of the next cartridge after a firing, as will be subsequently described.

Figure 3:
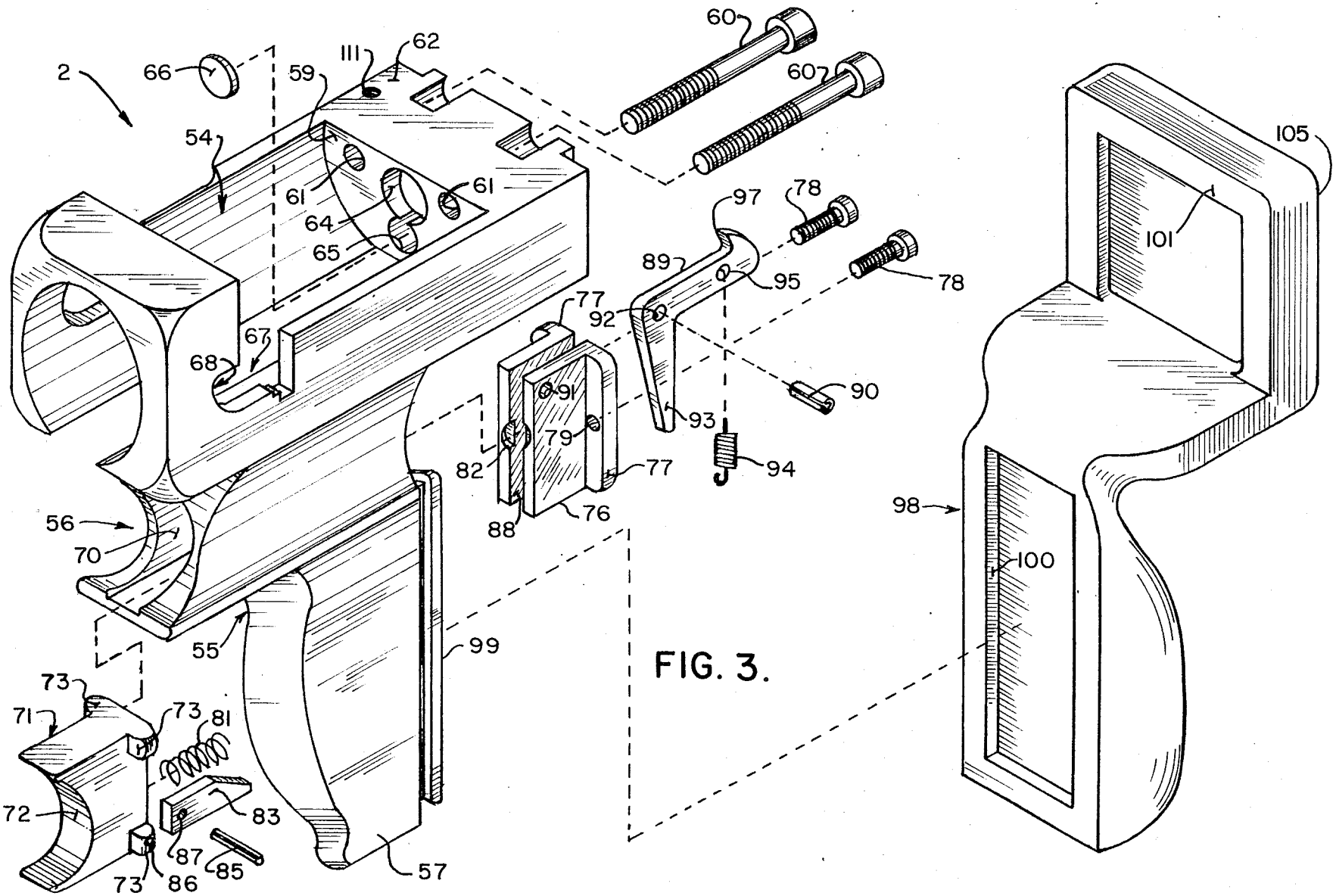
FIG. 3 is an exploded view of the handle means segment of the invention.

In addition, as can to be noted in FIG. 6, there are a pair tapped holes, as at 53, and which are provided for reception of fasteners for holding the handle housing, as shown in FIG. 3, to the feed housing support 6, as also will be subsequently defined.

The handle means 2 which also incorporates the trigger mechanism for this particular apparatus, as previously explained, is shown in FIG. 3. Basically, the means 2 includes a substantial opening, as at 54, and into which the housing surface structure 6 inserts during tool assembly. In addition, the handle portion 55 includes a trigger mechanism housing 56 and a downwardly depending handle 57, as noted. Obviously, the handle 57 is provided for, and is significantly shaped, for ease of grasping by the hand, and to provide stable support for the apparatus during its firing and usage. Furthermore, the handle means 2 has its shaped aperture, as at 54, and it is through this particular aperture that the feed housing surface 6 complimentary fits, as explained, with the back edge of the feed housing support 6, as along its surface 58, and provided for snug resting against the internally arranged surface 59 where it is held in position by means of the threaded fasteners 60, each of which respectively inserts within its counterbored holes 61, for threaded engagement within the tapped apertures 53, provided within the feed housing support 6, as previously explained with respect to the definition of FIG. 6. See also FIGS. 9 and 10. This is the sole means for tightening of the handle means 2, to the feed housing 6, and its forwardly extending integral tubular housing 5, as previously explained. When the handle housing 2 is assembled with or has affixed therein the feed housing support 6, the upper surface 62 of the handling means and that stepped upper disposed surface 63, of the feed housing 6, as can also be seen in FIG. 2, are flush with respect to each other. In addition, a counter bore 64 is provided within the surface 59, of the handle means, and this counter bore is formed in alignment with the firing pin mechanism 25, and actually functions as a backseat for the firing pin spring 36, as previously noted. In addition, a second counter bore 65 is provided into the surface 59, and functions as back mount for the push rod spring 38, as also previously defined. In practice, the formation of the counterbore 65 has proved rather difficult, and therefore, to form it, a hole was drilled at the vicinity of the counterbore 65, and a plug 66 was press fitted into position at the back end of the formed aperture 65, to form the desired counterbore.

At this juncture it might be commented that also formed laterally of the handle housing 2 is the clearance slot, as at 67, and which is formed in alignment with the related clearance slot 49, as previously explained, so as to provide for the convenient lateral feed and movement of the cartridge strip C, through the apparatus, during its repeated usage. The back of this clearance slot is rectangularly shaped, for snug reception of the cartridge strip therein and for its lateral movement through the tool during usage. Although, it may be commented at this time that the clearance slot does provide the forwardly shaped cavity portions, as at 68 and 69, respectively of the means 2 and 6, and which conveniently provides sufficient clearance for the casing portion $C_1$ of the cartridge, as it is automatically laterally fed through the apparatus, as during application.

Figure 31:
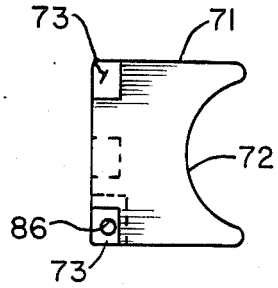
FIG. 31 is a side view of the trigger means of the invention, as also shown in FIG. 3.
Figure 32:
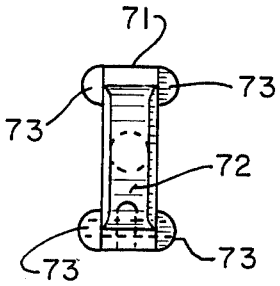
FIG. 32 is a front view thereof.
Figure 33:
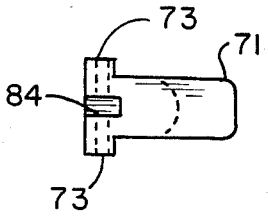
FIG. 33 is a bottom view thereof.
Figure 34:
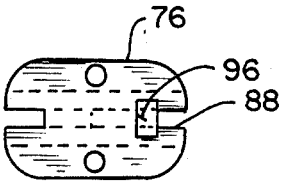
FIG. 34 is a back view of the trigger holder, as also shown in FIG. 3.
Figure 35:
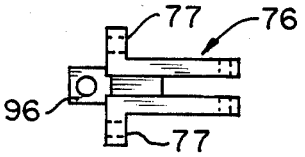
FIG. 35 is a top view thereof.
Figure 36:
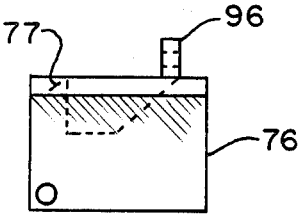
FIG. 36 is a side view thereof.

Downwardly of the handle housing 2 is a trigger portion 56 and which incorporates the various trigger mechanisms which provide for the convenient triggering of the tool during firing. For example, the trigger housing incorporates an integral chamber, as at 70, therethrough. A trigger 71 conveniently fits within the cavity 70, and has an arcuate or concave portion 72, formed forwardly thereof, and for the convenient grip by the index finger upon firing of the apparatus. To provide for a reduced frictional sliding of the trigger 71 within its cavity 70, a series of integral tabs 73 extend laterally from the trigger, and are disposed for reduced contact against the side of the cavity 70, so as to facilitate the movement of the trigger by the finger as discharge of the apparatus is performed. See also FIGS. 31 through 33. In also referring to FIGS. 9 and 10, the chamber 70 incoporates a series of lateral slots 74 in which the trigger tabs 73 conveniently locate, but as can be seen from FIG. 10, these slots 74 terminate at the surface 75, so as to provide a stop against any further forward movement of the trigger, within the handle housing. Obviously, the trigger 71 is inserted into the chamber 70 through its back opening. Also provided for locating within the trigger chamber 70 is a holder 76, which includes a pair of rearwardly but integrally formed flanges 77, with said holder 76 fitting within the chamber 70, and threaded fasteners as at 78, fitting through their respective flange apertures, as at 79, for fastening into the tapped holes 80, provided internally of the trigger housing area 56. A further disclosure of the holder is shown in FIGS. 34 through 36. A spring 81 biases against the back surface of the trigger 71, and conveniently fits within a segmented counterbore, as at 82, provided at the front edge of the holder 76, for conveniently and continuously biasing of the trigger 71 forwardly, and for exposure through and forwardly from the chamber 70. Also, as can be seen, there is a wedge shaped member 83 that fits within a slot 84, provided at the lower back edge of the trigger 71, and a mounting pin 85 inserts through and is pressure fitted within the apertures 86 provided through the lower trigger tabs 73. In addition, the mounting pin 85 inserts also through the aperture 87 of the wedge, for firmly securing the member in place and to become an integral part of the trigger 71. This wedge 83 has clearance for moving into the bottom of the slot, as 88, formed through the holder 76, as can be seen. Mounted within the holder 76, for pivotal movement therein, is a trigger lever 89, being held for pivotal movement within the holder 76 by means of the pin 90 which likewise pressure fits within the apertures 91, for pressure fitting therein, while also loosely inserting through the aperture 92 to effect the pivotal mounting of the said trigger lever 89 therein. Thus, as can be seen, the trigger lever incorporates a downwardly extending leg 93, extending approximately towards the bottom of its holder 76, and which is positioned for being contacted by the trigger wedge 83, for effecting pivotal movement of the lever, as the trigger 71 is pulled rearwardly, in preparation for firing of the apparatus. On the other hand, when the trigger 71 is released, and its spring 81 biases it forwardly, a spring 94 connects with the trigger lever, as at its aperture 95, for pulling its upper leg downwardly, to effect a repivoting of its downward leg 93, once again forwardly, during resetting of the apparatus. The spring 94, at its lower end, hooks onto the integral tab 96 of the lever holder 76, as can be seen in FIG. 36. The rearwardly extending or upper leg of the trigger lever 89 has an upwardly extending triggering segment 97, and it is this particular segment that contacts against and urges upwardly, the protrusion 35 of the sear means 27, during firing, so as to lift it from its push rod 32, or more specifically its slot 34, during firing of the apparatus.

In order to provide a shield for these operating components particularly at the back end of the handle means 2, and for sheltering against the back edge of the feed housing mechanism 3, there is provided a cushioning means 98, which is peculiarly shaped for snug fitting by means of snap clasping against the backend of these components, and which not only shields against the entrance of dust or other elements into the operating components of the apparatus, but likewise affords further attributes, as to be explained. See also FIGS. 37 through 40. As can be seen, particularly in FIGS. 3, 9, and 10, integral ribs 99 are provided around the perimeter of the handle 57, and are designed for engaging in retention the integrally formed flanges 100 formed of the cushioning means 98. In addition, similar type of flanges, as at 101, are likewise provided at the upper segment of the cushioning means 98, and for engaging onto similar type of ribs 102 provided at the upper back of the feed housing as shown, and as will be subsequently defined, in FIG. 4. But, in addition, as can be noted in FIGS. 9 and 10, the handle gripping portion 57 of the trigger housing incorporates a sizable cavity, as at 103, therein, and which cavity is useful for holding of various tools, such as screw drivers, Allen or hex wrenches, or the like, that are useful for servicing of the apparatus, as necessary, and when needed. Or, in the alternative, it is just as likely that spare cartridges could be located therein for storage, if desired. In any event, as can also be seen in FIGS. 37 through 40, the cushioning means is conveniently shaped, particularly at its downward segment, as at 104, to provide sufficient bulk to ease the gripping of the entire apparatus during its usage, and to cushion the hand against recoil, during firing of the apparatus as during application. The upward segment 105 of the cushioning means is generally flattened in configuration, and is there designed particularly to provide overlying coverage and closure to the various operating mechanisms disposed at the rearward segment of the upper handle means 2, in addition to the feed housing mechanism 3, as shown in FIG. 1.

Figure 4:
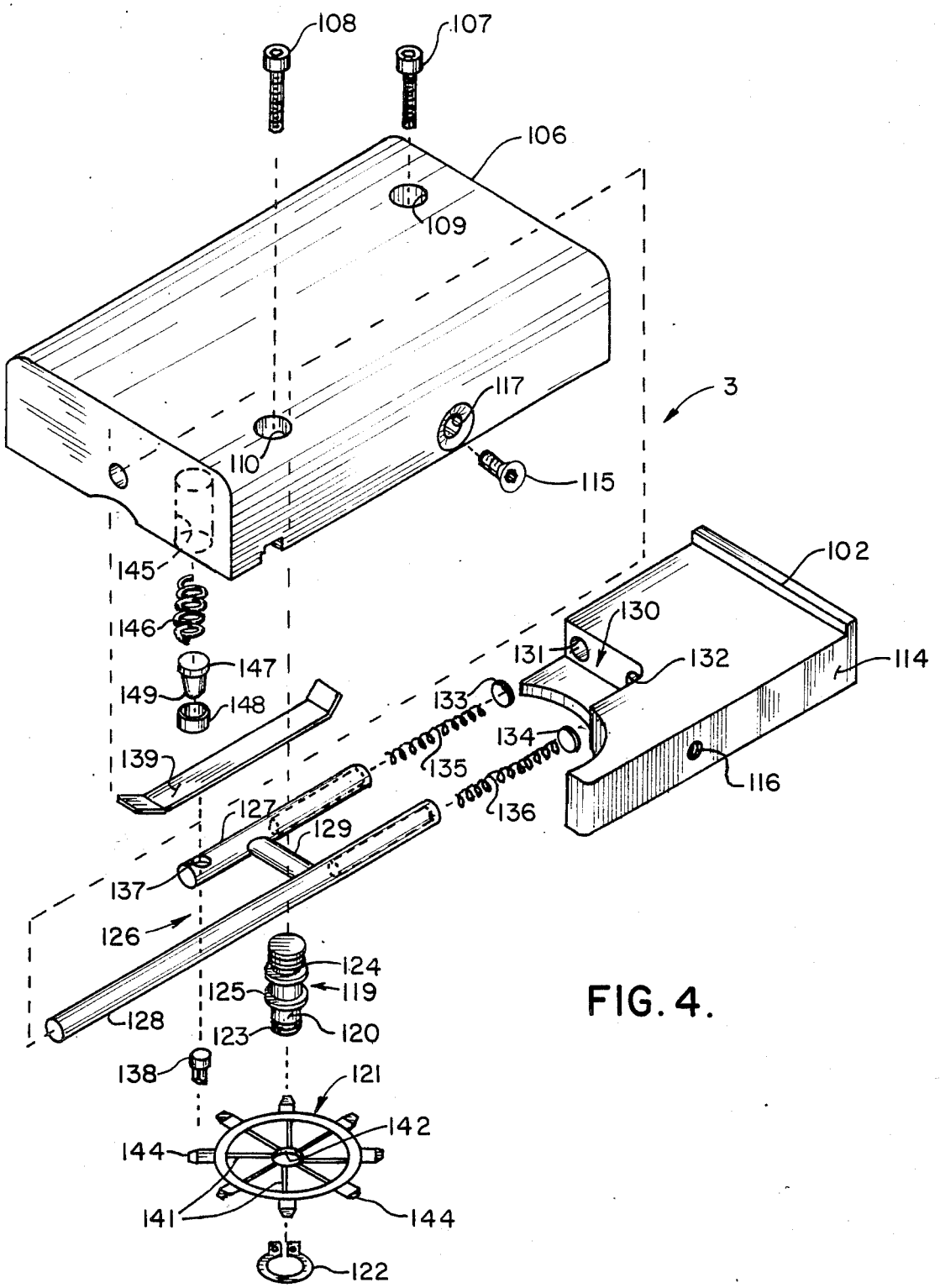
FIG. 4 is an exploded view of the feed housing segment of the invention.
Figure 41:
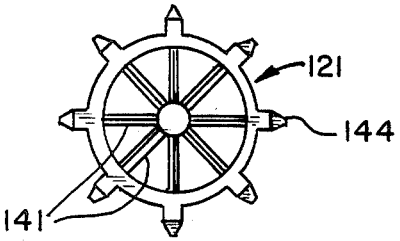
FIG. 41 is a top view of the index wheel of this invention, as shown in FIG. 4.
Figure 42:
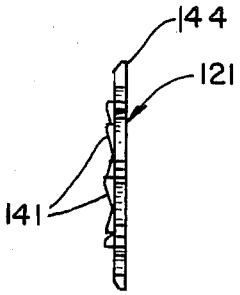
FIG. 42 is a side view thereof.

The feed housing mechanism 3 of this particular invention is more aptly described in an exploded view as shown in FIG. 4. In addition, references are made to FIGS. 11 through 16. This feed housing operates to basically provide the means for automatic shifting of the cartridge strip C through the apparatus, during continued usage and firing of the device while driving fasteners into their supporting surface. Generally, as can be seen, the feed housing incorporates a cover segment 106, and which is designed for flush mounting upon the aligned surfaces 62 and 63 of the handle means 2 and the housing support 6, respectively. And, as can be noted, when secured into position, a pair of threaded fasteners 107 and 108 respectively insert into and through their apertures 109 and 110 for securement within the tapped apertures 111 and 112, respectively, of the said handle and feed support housing, as defined. In specifically referring to FIGS. 11 and 14, it can be seen that the cover means 106 includes a formed cavity 113 and into which a lower feed housing 114 conveniently inserts, and which is held into position by means of a threaded fastener, as at 115, which threadedly engages within the tapped hole 116 provided at the side of the lower feed housing 111, after the fastener freely inserts through the aperture 117 provided through the upper feed housing 106. The head of the threaded fastener 116 tightly engages within the countersunk hole 117 as provided at the side of the feed housing cover 106, as can be seen. The feed housing cover means 106, and the lower feed housing 114, provide the structural support for the various operating components that afford the automatic and lateral feed of the cartridge strip C through the apparatus, during usage. Generally, there is an indexing of this cartridge strip laterally through the apparatus, during its operation. Structurally, to achieve such, the cover means 106 incorporates a threaded or tapped aperture, as at 118, and into which a threaded shaft 119 permanently engages. The lower end of the threaded shaft 119 incorporates a shank portion 120, and onto which an indexing wheel 121 freely mounts, so as to provide for its indexed rotation during repeated usage and application of the apparatus. See also FIGS. 41 through 43. A snap ring 122 conveniently is snapped into position within an integral groove 123 formed proximate the lower end of the shank 120. At the midsection of the threaded shaft 119 are a pair of guides 124 and 125, their function of which will be subsequently analyzed. As can also be seen, there is a shuttle or carriage means 126 formed of a pair of legs 127 and 128, and which are integrally spaced apart by means of the lateral brace 129, as noted. The lower feed housing 114 incorporates a recessed portion 130, and counterbored or drilled into this recessed portion are a pair of apertures 131 and 132, as can be seen. For the convenience of manufacturing, these counterbores are actually formed by drilled holes extending through the lower feed housing 114, with their back ends pressure capped by means of the pressure plugs 133 and 134, to form the desired counterbore like structure for the housing 114. Designed for fitting within these counterbores 131 and 132 are their aligned springs 135 and 136, respectively, and which likewise are designed for reception into these counterbores are the back ends of the legs 127 and 128 as can be seen. Thus, there is a constant biasing forwardly of the carriage means 126, as can be determined. In addition, the leg 128 of the carriage means rides between the guides 124 and 125, and in conjuntion with the brace 129, limits the forward shift of the said carriage means. Provided at the forward end of the leg 127 is an aperture, as at 137, and disposed for locating therethrough is a dog 138 which is continuously spring biased downwardly, by means of the leaf spring 139, which conveniently fits within its shallow cavity 140, formed within the interior upper surface of the feed mechanism cover means 106, as can be seen also in FIG. 11. As the carriage means 126 is longitudinally shifted, during operations of the device, it can be readily seen that the dog 138, or more particularly its downward edge, engages against the radially disposed ridges, or surface gears, as at 141, provided around the central aperture 142 of the said index wheel 121. Thus, each rearward shift of the carriage means 126 pulls with it its dog 138, and provides for an incremental indexing of the star wheel 121, to that dimension which provides for a lateral shift of the cartridge strip C segment, or until the next cartridge $C_1$, just adjacent to the just spent cartridge comes into position aligned with the firing pin mechanism of the apparatus. Movement or shifting of the carriage means 126 will be subsequently defined, in explaining the method of operation of the apparatus, but it must be noted that the forward segment of its leg 128 inserts into and through a channel 143, provided through the forward portion of the cover means 106, with the forward edge of the leg 128 being disposed for contact with the barrel cylinder means 4 of the apparatus, for providing for this resetting of the cartridge strip C, each time a firing occurs, in preparation for the next application of the apparatus.

It should be commented herein that the teeth 144 of the index wheel 121, during each indexing shift of the wheel through operations of the carriage means 126, and its cooperating dog 138, are designed for engagement within the formed slots $C_2$ provided along the upper edge of the cartridge strip C, in order to provide for that definite shift of the strip laterally through the apparatus, to achieve that alignment for the next cartridge in preparation for firing of the apparatus. In addition, it is desired to provide for a firm positioning of the cartridge strip in position, once set by the index wheel 121, while a firing occurs, and this is achieved as follows. The cover means 106 has a counterbore 145 provided therein, and within the counterbore are located a spring means 146, and a positioning pin 147. A pressure fitted ring 148 snugly inserts within the counterbore 145, to permanently retain the said positioning pin, and its spring, in place. It is to be noted that the downward surface of the positioning pin 147 is convexly formed, as at 149, disposing a width compatible to the slots $C_2$ formed along the upper edge of the cartridge strip C. Thus, as the cartridge strip is fed laterally through the apparatus, the convex tip of the positioning pin 147 is designed for riding upon this upper disposed edge of the said strip, and to become positioned within an aligned slot $C_2$ disposed along the upper edge of the strip, and to hold the strip in position during the next firing of the apparatus. On the other hand, as the index wheel 121 indexes the cartridge strip C to the next position, the positioning pin 147 can conveniently bias upwardly against its spring 146, and ride along this upper edge of the cartridge strip C, until it falls into position within the next and adjacent slot $C_2$ of the said cartridge strip C. Thus, there is a reasonably firm fixation of the cartridge strip into position, during each firing of one of its cartridges, as during repeated usage of the apparatus. It might be commented at this juncture that the cartridge strip C, as can be seen, includes a plurality of these aligned slots $C_2$ not only along its upper edge, but likewise, there are corresponding type slots $C_2$ also formed along the bottom edge of each strip, and the purpose of this is for the convenience of the user, so that regardless how the strip may be inserted within the apparatus, there will always be a series of aligned slots provided along whatever upper disposed edge for the strip is inserted into the apparatus, to dispose those slots to the said pin.

Figure 43:
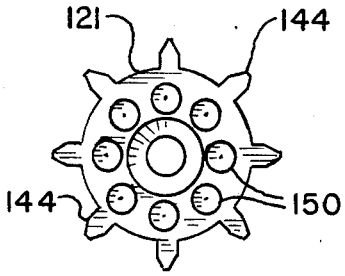
FIG. 43 is a bottom view of the index wheel of this invention.

In referring also to FIG. 43, it can be seen that the bottom surface of the index wheel 121 incorporates a series of shallow cavities 150, and for the following purpose. As the index wheel 121 is indexed its particular degrees, generally around forty-five degrees, or just short thereof, during each index, while the carriage means 126, and its dog 138, may continue to move rearwardly, the dog 138 at about or slightly less than that forty-five degree turn clears its beveled surface gears 141, and therefore, there is need for precisely finally positioning of the index wheel 121 for its final setting of the cartridge strip C in preparation for firing. Hence, as can be seen, the shallow cavities 150 are sufficiently aligned with their respective index teeth 144, and as the index wheel approaches that approximate forty-five degree shift, the positioning pin 50 (see FIG. 2) rides into and finally sets at the lowest position of each shallow cavity 150, then aligned with it, so as to provide for that final setting of the index wheel, and its shifting of the cartridge strip C, into an alignment with the firing chamber, and firing pin 25, of the apparatus.

In addition to the foregoing, it might be noted that the interior lower surface of the feed housing cover means 106 is conveniently shaped, as at 151, to provide clearance for the rotating index wheel 121. In addition, as can likewise be seen, there is adequate annular clearance, as at 152, formed of the lower feed housing 114, for the similar purpose.

As can also be seen in FIG. 4, the lower feed housing 114 incorporates that ribbed element 102, that extends slightly rearwardly of the cover means 103, and therein disposes its said rib 102 for engagement by the upper flanged portion 101, of the cushioning means 98, for holding it into position, at its upper segment, against the back of these feed housing components, and to protect them thereat.

Figure 18:
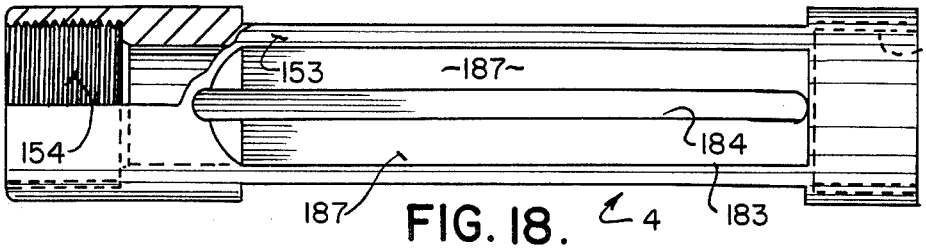
FIG. 18 is a bottom view of the barrel cylinder means shown in FIG. 5.
Figure 19:
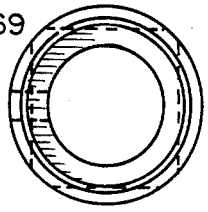
FIG. 19 is an end view thereof.
Figure 20:
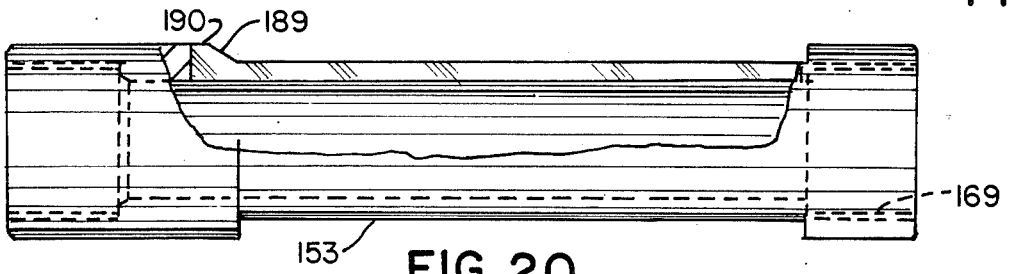
FIG. 20 is an inverted side view, partially broken away, of the barrel cylinder means shown in FIG. 18.
Figure 21:
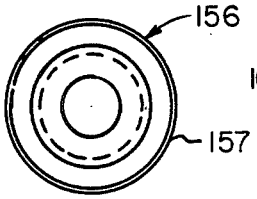
FIG. 21 is an end view of the plunger housing of the invention, as also shown in FIG. 5.
Figure 22:
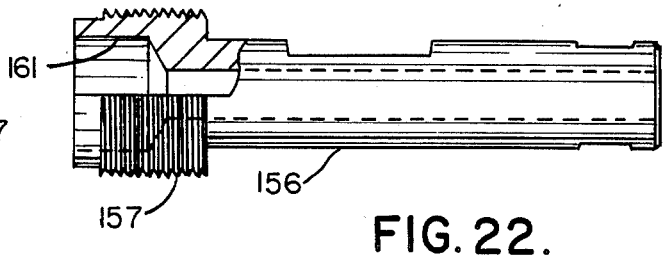
FIG. 22 is a side view thereof, partially broken away to show its internal chamber.
Figure 23:
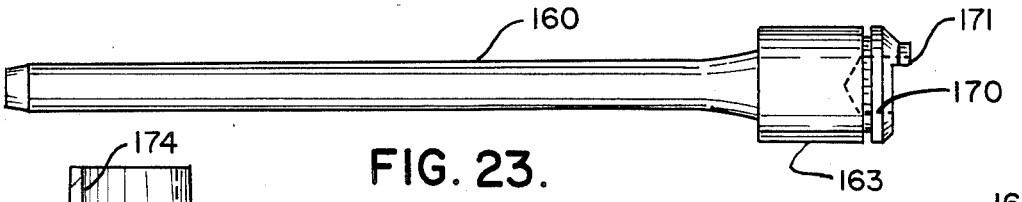
FIG. 23 is a side view of the piston rod of this invention, as also shown in FIG. 5.
Figure 24:
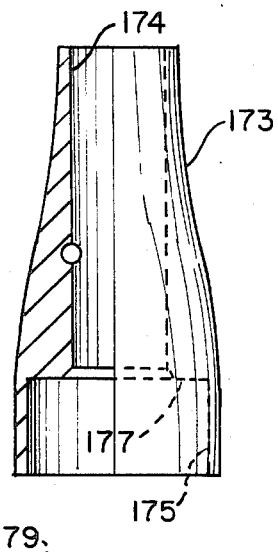
FIG. 24 is side view, partially broken away, of the guard means of this invention, as also shown in FIG. 5.
Figure 25:
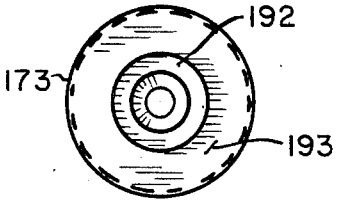
FIG. 25 is a front view of the barrel insert means of this invention, as also shown in FIG. 5.
Figure 26:
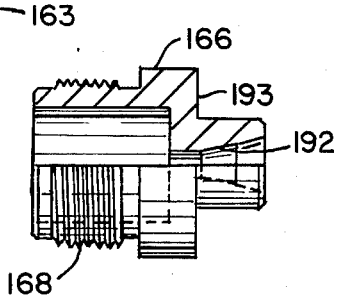
FIG. 26 is a side view of the barrel cylinder insert shown in FIG. 25, partially sectionalized.
Figure 27:
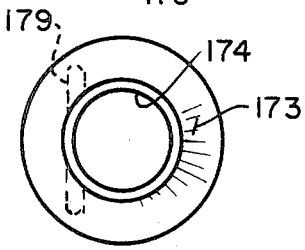
FIG. 27 is a front view of the guard means of the invention as shown in FIG. 24.

As can be seen in FIG. 5, and referring once again to FIG. 1, the various operating components forming the barrel cylinder 4 of this invention are disclosed in an exploded view. These particular components, when assembled, are provided for reciprocal but limited longitudinal movement within the tubular housing 5, as previously explained. See also FIGS. 18 through 27 as explanation is made hereinafter. Generally, the barrel cylinder components include a barrel cylinder 153, which includes an internal channel along its length, and incorporating a series of threads, as at 154, at its frontal segment. Designed for threadedly engaging within the channel 155 is a plunger housing 156, which has a threaded integral sleeve 157, as can be seen, and which is designed for threaded engagement within the threaded segment 154 of the barrel cylinder 153. The plunger housing 156 includes a pair of wrench gripping slots 158 for the convenience of tightening of the plunger housing 156 within the barrel cylinder 153. The plunger housing 156 likewise has an internal channel 159 provided therethrough, and is disposed for reception of the piston 160 therein. The plunger housing 156 has a counterbore, as at 161, provided within its back end, and disposed for inserting therein is a sleeve 162, and in this particular instance being formed as a leaded sleeve, and which is designed for cushioning against the impact of the piston 160, and more specifically its englarged end 163, in the event that the apparatus should be fired without a fastener having been loaded therein, or in the event that the cartridge used may be designed for a heavier power load than that which is required for the given application. Thus, if a too heavy of a drive is made to the piston 160, during its application, and which is excessive to that which is required for driving of the fastener being used, and should the piston rod 160 be thrusted too forwardly during an explosion, then the leaded overdrive washer 162 is intended to cushion the impact of that force, through abrupt contact therewith of the piston rod sleeve 163. The back end of the piston rod 160, or its end 163, includes a shallow groove 164, and upon which a ring 165 rides, for purposes of functioning in the capacity of a piston ring for retention of the forces of combustion during firing of the apparatus. A barrel insert means 166 has a bore provided therethrough, as at 167, and into which the end 163 and the piston ring 165 may ride, for longitudinal shifting therein, during fuctioning of the apparatus. The insert means 166 has external threads provided thereon, as at 168, and designed for threaded engagement within the barrel cylinder 153, by interengaging with its threads 169, as can be seen in FIGS. 18 and 20. In any event, the piston 160 is designed for convenient riding within the chamber 159 of the plunger housing 156, and through that relationship, the plunger 160, and its integral enlarged end 163, with its ring 165, are free for longitudinal shifting within the barrel cylinder 153, and its insert end 166, as explained. The back end of the piston 160 has a counterbore, as at 170, provided therein, and a partial extension, as at 171, which are conveniently designed to provide that degree of piston chamber necessary to conveniently provide that degree of thrust necessary for the piston rod 160 to drive it and any fastener loaded against its front surface 172, during loading and application of apparatus. See, once again, FIG. 23.

A guard means 173 is provided for mounting upon the front of the plunger housing 156, and the guard is peculiarly shaped having a cavity 174 therein, for snug but sliding engagement upon the said plunger housing. The guard incorporates another counterbore, as at 175, and into the counterbore is designed to fit a spring means 176, to engage against its shoulder 177, at one end, while engaging against the plunger housing shoulder 178, at its other end. And, the guard 173 is held in sliding engagement with the plunger housing 156 through the agency of a spring roll pin 179, which inserts through the tangential slots 180, and which pin is aligned for off center location along the slot 181, formed laterally of the plunger housing 156, as can be seen in FIG. 5. Thus, the spring 176 continuously biases under some degree of force the guard 173 forwardly of the plunger housing 156, at a forwardmost position of the entire apparatus, as can also be seen in FIG. 1. This guard means 173 can be generally defined as a nonairfired guard means. The purpose for this is that without the guard means, the plunger housing 156, and the barrel cylinder 153, could conceivably be pushed rearwardly into cocking of the entire apparatus for firing, including its piston 160, since the trigger mechanism will have become reset for refiring. But, with the guard means 173 thereon, a pull back of the guard means alone, while providing for some rearward movement or withdrawal of the plunger housing 156, said guard means, at its back edge 182, comes to rest against the front end of the tubular housing 5, so as to prevent a full recocking of the plunger housing 156, and its piston 160, for refiring. Thus, while a premature firing of the apparatus would not necessarily present harm or injury to the user, it certainly would provide an impact of shock or fright, which can be avoided through the application and operations of the guard means 173, of this invention.

Upon reviewing the barrel cylinder 153, it can be seen that it includes a series of flattened surfaces, as at 183, around its perimeter. These are provided for clearance purposes, for collection of any dirt or debris that may enter between the barrel cylinder 153, and within the tubular housing 5, during repeated and continuing usage of the apparatus. These flattened surfaces are provided around the entire perimeter of the cylinder housing 153. In addition, as can be seen in FIG. 18, there is a slot 184 provided longitudinally along the bottom of the barrel cylinder 153, and this particular slot is designed to provide clearance for the tang 20, and more specifically its upper edge 185, to insert therethrough, and for application for recocking of the piston during setup for a next firing. More specifically, the tang extension 185 is designed for engagement against the shoulder 186 of the piston end 163, during a resetting of the piston for a subsequent firing. It is to be noted that the barrel cylinder 153 has a pair of races 187 formed of a bottom flattened surface 183, as shown in FIG. 18, and it is upon these races that the shoulders 188 of the tang 20 ride during a resetting of the piston and its barrel cylinder 153 and the plunger housing 156 during resetting. But, as can also be seen, the races 187 incline outwardly, as at 189, at their forwardmost end, and provide a slight segment of an outer perimetered race 190 at their forwardmost ends, as at the forward edge of the slot 184. The purpose for this is to provide for an outward shift of the tang 20, as it reaches the forward end of the slot 184, to clear it from any engagement with the piston 160, and more specifically its shoulder 186, when the apparatus has been readied for firing, and during a firing.

A general description of the operations of this particular apparatus, in view of the structural components from which it is fabricated, can now be made in light of said previous description, and the drawings. For purposes of describing the operations of the device, a starting point will be that the apparatus will have just previously been fired, and is now ready for resetting. Under this condition, obviously, a spent cartridge Cl of the cartridge strip C will yet remain in alignment within the firing chamber of the apparatus, and said spent cartridge will still remain aligned with the firing pin assembly 25. At this stage, likewise, the entire cylinder assembly, including the barrel cylinder 153, and its threadedly engaged components such as the plunger housing 156, and the insert 166, will be at their rearwardmost positions within the tubular housing 5. This is so because with the apparatus having just been fired, the operator will still be manually applying pressure to the handle 2 of the device, and yet pressuring it against the structural surface into which a fastener will have just been shot. But, at that time, since a firing will have just taken place, the piston 160 will be at its forwardmost position within the barrel cylinder 153, with the front surface of the piston, or that surface 172, being somewhere in alignment with the front edge 191 of the plunger housing 156. In addition, the carriage member 126, with its front surface of the leg 128 biasing against the back of the insert means 166, will likewise be retracted and forced rearwardly within the lower feed housing 114, with its dog 138, of the other leg 127, being arranged rearwardly and clear of the index wheel 121, and more specifically its beveled surface gears 141. In addition, obviously, the push rod 32, and more specifically, since its forward end is likewise in contact with the back surface of the insert means 166, of the barrel cylinder 153, the push rod 32 will also be arranged at its rearwardmost position, with the sear means 27, and more specifically its downwardly depending stem 35, riding on the upper surface 37 of the said push rod 32. In addition, since a firing will have just taken place, the firing pin housing 41, and all the firing pin associated components will be biased forwardly, through the urging of the firing pin spring 36, as previously explained. In addition, the tang 20, and more specifically its upwardly extending edge 185, will be arranged upwardly upon the outwardly disposed race surfaces 187, since the barrel cylinder 153, as previously explained, is at a rearwardmost position.

At this juncture, the operator will remove the apparatus from its pressuring against the structural surface into which a fastener has just been fired. When this occurs, the front of the push rod 32 becomes clear of the back edge of the insert means 166, and means that the urging of its spring 38 will force the push rod forwardly, within its chamber 31, and thereby allow the sear mechanism 27, and more specifically its stem 35, to descend within the slot 34, in preparation for refiring. In addition, the carriage means 126 is allowed to move, once again, forwardly, since the forward surface of the leg 128 is becoming freed from the pressure of the insert means 166, as the barrel cylinder 153 moves forwardly, upon release. As this occurs, the dog 138 likewise moves forwardly of is lower feed housing 114, and it becomes positioned slightly forwardly of the aligned beveled furface gear 141, in preparation for resetting of the index wheel 121, as to be subsequently defined. At this juncture, the barrel cylinder 153, and its various connecting components, has some degree of freedom for longitudinal shifting with respect to the tubular member 5, of the apparatus. At this time, the barrel cylinder 153, and all of its components, can be manually urged forwardly of the tubular housing 5. As this occurs, the tang 20 rides from its ascended position upon the race section 190, down its incline 189, becoming positioned for movement along the race surfaces 187. At this juncture, the apparatus is at a static stage, cannot be refired, but is ready for resetting for another firing and applying of a fastener to a structured surface. When the barrel cylinder is manually pulled or urged forwardly, the tang 20 generally rides along the length of the slot 184, and as that is occurring, the tang extending edge 185 engages against the piston shoulder 186, and draws the piston 160 rearwardly into a reset position in preparation for the next firing. The enlarged end 163 of the piston will now be at its rearwardmost position, closing part of the slot 184, to present a closed combustion chamber for a refiring. At this stage, another fastener can be reloaded into the plunger housing, and more specifically into its barrel chamber 159 for reloading of the apparatus. It might be stated that the fasteners as used in this type of a nail gun are rather standard in the art, and are readily available from a variety of sources, they do have particular dimensions, and when reloaded into the barrel chamber of the plunger housing, are free to move reasonably downwardly into the barrel, and come into position resting against the surface 172 of the piston 160. Then, the entire apparatus is placed into position against the strucutral surface into which the next fastener is desired to be inserted, and force is applied upon the handle segment of the tool, and the entire barrel cylinder, in addition to its barrel cylinder 153 and its connected barrel insert means 166, are forced with pressure rearwardly into the tubular cylinder 5, until such time as the back edge 182 of the guard means 173 moves towards proximity with the front edge 5A of the barrel tube 5, but more specifically, until that time as the cartridge chamber 192 biases firmly against the cartridge casing $C_1$, thereby disposing the front part of the cartridge tightly within the said cartridge chamber, and readied for firing. See also FIG. 26.

But, as this rearward shifting of the barrel cylinder occurs, under pressure, as the apparatus is pushed against the structural surface into which the fastener is to be fired, the front surface of the leg 128 of the carriage means 126 once again engages against the back surface, or shoulder, as at 193, of the barrel insert 166, and the said carriage means 126 is likewise shifted rearwardly, against the bias of its springs 135 and 136, and as this occurs, the dog 138, of the other carriage leg 127, contacts against one of the surface gears 141, of the index wheel 121, shifting it approximately forty-five degrees, or close thereto, at which time the stem 52 of the positioning pin 50 enters into the next shallow cavity 150, of the index wheel 121, to precisely locate it at its next setting. But, obviously, as this is occurring, the turn of the index wheel 121 causes its next extended tooth 144 to engage within the next adjacent slot $C_2$ of the cartridge strip C, and thereby shift it one index, or one position, for alignment of the next cartridge into position for a refiring of the apparatus. As the cartridge strip C is being fed one dimension, and as previously explained, the contoured surface 149 of the pin 147 will ride along that upper edge $C_3$ of the cartridge strip, and become depressed into engagement with its next adjacent slot $C_2$, for holding the said cartridge strip in position during the next firing.

Furthermore, as the front edge of the push rod 32 engages against the surface 193 of the barrel insert means 166, and since the downwardly depending stem 35 is becoming located within the push rod slot 34, the entire sear 27, and its projecting pin 29, located within the firing pin housing aperture 26, are shifted rearwardly, under force, and against the bias of the firing pin spring 36, to recock it into position for the next firing.

When the entire apparatus is fully forced against the structural surface in which a fastener is to be fired or inserted, and the cartridge chamber 192, at that time, comes into position biasing against the next cartridge of the cartridge strip C, and with the next cartridge becoming located within said chamber at this time, the entire apparatus is ready for refiring. Thus, when in this position, and the operator will have the apparatus fully aligned with the structural surface in which the next fastener is to be shot, the operator need simply to commence to squeeze the trigger 71, rearwardly, thereby causing its trigger wedge 83 to likewise move rearwardly, and bias against the trigger lever 89, and more specifically its downwardly depending leg 93, thereby causing its upper leg to pivot upwardly, and effecting a contact between the triggering segment 97, which will by now have become aligned with the sear extension 35, until such time as the trigger is reaching a full position of pull, such that the sear extension or pin 35 will be forced out of its slot 34, and thereby allow the firing pin housing 41 to be thrusted forwardly, under the force of its spring 36, in the manner as previously explained, for driving its pin 42 into the rear of the aligned cartridge, and attain instantaneous firing. When this occurs the piston rod is exploded forwardly, due to the developed combustion formed within its piston chamber 170, so that the fastener aligned with the front surface 172 of the piston is driven under enormous forces into the structural surface into which it was intended to be inserted, whether it be a concrete surface, metal surface, or any other form of structure. At this stage, the piston rod will have driven the fastener into the structural surface. In addition, as the piston end clears the back end of the slot 184, the exhaust gases are free to pass into the debris attractor for collection. At this stage, the entire apparatus can then be reset, in the manner of operation as herein just previously reviewed for the entire apparatus.

Variations or modifications to the structure and assembly of the components for this particular development may occur to those skilled in the art upon reviewing the description of the embodiment as set forth herein. Such variations or modifications, if within the spirit of this invention, are intended to be encompassed within the scope of any claims to patent protection issuing hereon. The description of the preferred embodiment set forth within this application is provided for illustrative purposes only.

Having thus described the invention what is claimed and desired to be secured by Letters Patent is:

1. A fastener driving tool for use for driving a nail or other anchor into a hardened surface such as a concrete, metal, or the like, said tool useful for feeding a cartridge strip of magazined explosive cartridges through the tool for repeated subsequent driving of a plurality of fasteners into such a surface, said tool including a handle means, a tubular housing provided extending forwardly from said handle means, a barrel cylinder means provided for limited reciprocal movement within said tubular housing, a cartridge chamber provided at the rear of said barrel cylinder means for contiguous reception of a cartridge therein in preparation for firing, a piston provided within the barrel cylinder means and provided for reciprocal movement therein between a set position arranged approximate the back segment of said barrel cylinder means and at its front segment as after a firing and driving of a fastener in place, said barrel cylinder means and piston capable of being reset in preparation for a refiring, a feed housing means operatively associated with the handle means, and barrel cylinder means, and providing an indexing of the cartridge strip through the feed housing means upon the handle means for selective positioning of a next cartridge aligned with the cartridge chamber in preparation for a next firing, indexing means operatively associated with the feed housing means, and an indexing wheel included within the indexing means and provided for the sequential shifting of the magazined cartridges through the tool during usage.

2. The invention of claim 1 and wherein said indexing wheel providing for the lateral shifting of the cartridge strip through the tool during its application.

3. The invention of claim 2 and further including a carriage means supported by the feed housing means, said indexing wheel responsive to the movement of said carriage means during indexing of said cartridge strip, and said carriage means being responsive to the rearward movement of said barrel cylinder means for effecting shifting of the next cartridge into position for alignment with the cartridge chamber in preparation for the next firing of the tool.

4. The invention of claim 3 and wherein said carriage means longitudinally shifts within the feed housing means, and said indexing wheel being horizontally disposed for partial turning during each shift of the said carriage means.

5. The invention of claim 4 and including a dog carried by the carriage means, said index wheel having surface gears provided thereon, said dog disposed for engagement with the surface gears during each rearward shift of the carriage means for providing a predetermined partial turn of the indexing wheel for effecting shifting of the cartridge strip.

6. The invention of claim 5 and wherein said carriage means including a pair of legs, one leg supporting the dog, the other leg disposed for contact by the barrel cylinder means during its rearward movement as during a resetting of the tool for a subsequent firing.

7. The invention of claim 6 and wherein each leg of the carriage means also inserting within the feed housing means for support during its shifting.

8. The invention of claim 3 and further including a positioning means operatively associated with the tubular housing and provided in alignment with the indexing wheel for providing final positioning of the said indexing wheel for precise locating of the next cartridge in alignment with the cartridge chamber in preparation for the next firing of the tool.

9. The invention of claim 8 and wherein said indexing wheel having a series of shallow cavities upon its side opposite from its arranged surface gears, said cavities disposed for sequential reception of the positioning means therein.

10. The invention of claim 3 and wherein each cartridge strip having a series of spaced slots provided therein, said indexing wheel having a series of radial teeth provided extending therefrom, at least one wheel tooth engaging within a strip slot during indexing for providing the lateral shift to the cartridge strip in preparation for the next firing of the tool.

11. The invention of claim 10 and including a locating pin spring biased within the feed housing means and in alignment for riding upon an edge of the cartridge strip and for locating within a slot for further providing precise alignment of the next cartridge with the cartridge chamber for the barrel cylinder means in preparation for the next firing of the tool.

12. The invention of claim 3 and including a tranverse slot provided through the tubular housing and through which the cartridge strip is indexed in preparation for the firing of the tool, firing pin means operatively associated with the tubular housing means and in alignment rearwardly of the said slot arranged cartridge strip, and a trigger means carried by the handle means and which when shifted providing for actuation of the firing pin means and a firing of the aligned cartridge.

13. The invention of claim 12 and including a sear means operatively associated with the firing pin means, a push rod means cooperating with the sear means to hold it and the firing pin means in cocked position in preparation for a firing, a trigger lever means responsive to the shifting of the trigger means and providing for a release of the sear means for discharge of the firing pin means and a firing of the aligned cartridge, said sear means riding upon the push rod means after its release.

14. The invention of claim 13 and wherein said push rod means having an aperture therethrough, said sear means partially arranged within said aperture when arranged in its cocked position, and said trigger means pushing said sear means from said aperture for initiating a firing.

15. The invention of claim 13 and wherein the front of said push rod means contacting the said barrel cylinder means upon the forced rearward movement of the said barrel cylinder means for effecting a rearward shift the push rod means and a resetting of the sear means and its firing pin means in preparation for the next firing of the tool.

16. The invention of claim 5 and wherein said handle means having a cavity formed therein for storage of tools or the like, and a cover for the said cavity engaging upon the said handle means.

17. The invention of claim 16 and wherein said cover formed of cushioning material to absorb the forces of impact upon a firing of the tool.

18. The invention of claim 17 and wherein said cushioning material formed cover provided upon the back of the handle means.

19. The invention of claim 18 and wherein said cushioning material formed cover extending over the entire backside of the tool and also covering the rear of the said feed housing means.

20. The invention of claim 3 and wherein said tubular housing having an opening through its lower surface, said barrel cylinder means also having an opening through its lower surface and normally communicating with the tubular housing opening, a debris attractor mounting upon the tubular housing and communicating with its opening and provided for collecting any debris from the exhaust of the fired cartridge.

21. The invention of claim 20 and wherein said debris attractor having a substantial cavity formed therein for collecting an accumulation of the exhaust debris discharging upon the repeat firing of the tool.

22. The invention of claim 21 and wherein said debris attractor also designed for muffling the sounds generated during a firing of the tool.

23. The invention of claim 3 and wherein said barrel cylinder means also having a longitudinal slot formed therethrough, a tang means carried by the tubular housing, said tang means normally extending into the tubular housing slot and provided for shifting the piston rearwardly during a resetting of the tool, and said tang means being removed from the said tubular housing slot and free from the piston during a firing of a cartridge during usage of the tool.

24. The invention of claim 23 and wherein said barrel cylinder means having a race provided adjacent its formed slot, said tang means disposed for riding upon said race, said race at its forward end formed having an inclined raised portion, said raised portion of the race designed for withdrawing of the tang means from within the barrel cylinder means slot and its disengagement from the piston in preparation for a firing of the tool.

25. The invention of claim 3 and including a cushioning collar provided within the barrel cylinder means and disposed for contact by the piston means upon an override of the piston means during a firing of the tool.

26. The invention of claim 25 and wherein said cushioning collar comprising a leaded collar.

* * * * *

UNITED STATES PATENT AND TRADEMARK OFFICE

CERTIFICATE OF CORRECTION

PATENT NO. : 4,687,126

DATED : August 18, 1987

INVENTOR(S) : James R. Brosius and Ralph C. Brosius

It is certified that error appears in the above—identified patent and that said Letters Patent is hereby corrected as shown below:

Claim 16, line 1, change "5" to ---3---.

Signed and Sealed this

Nineteenth Day of January, 1988

*Attest:*

DONALD J. QUIGG

*Attesting Officer*

*Commissioner of Patents and Trademarks*